US006679640B2

(12) United States Patent
Smith

(10) Patent No.: US 6,679,640 B2
(45) Date of Patent: Jan. 20, 2004

(54) PRINTING SYSTEM WEB GUIDE COUPLING ASSEMBLY

(75) Inventor: Daniel E. Smith, Bristol, NH (US)

(73) Assignee: Vutek, Incorporated, Meredith, NH (US)

( * ) Notice: Subject to any disclaimer, the term of this patent is extended or adjusted under 35 U.S.C. 154(b) by 0 days.

(21) Appl. No.: 10/058,979

(22) Filed: Jan. 28, 2002

(65) Prior Publication Data

US 2002/0157555 A1 Oct. 31, 2002

Related U.S. Application Data

(63) Continuation-in-part of application No. 10/040,965, filed on Jan. 7, 2002.

(60) Provisional application No. 60/260,359, filed on Jan. 8, 2001.

(51) Int. Cl.[7] ..... B41J 29/02

(52) U.S. Cl. ..... 400/691; 400/692; 400/693; 347/108; 411/85; 411/104; 411/155; 411/354

(58) Field of Search ..... 411/84, 85, 104, 411/155, 354; 400/691, 692, 693; 347/108

(56) References Cited

U.S. PATENT DOCUMENTS

| | | | | | |
|---|---|---|---|---|---|
| 3,955,737 | A | | 5/1976 | Traise | 226/108 |
| 3,977,588 | A | | 8/1976 | Meade et al. | 226/168 |
| 3,995,548 | A | | 12/1976 | Mitter | 101/426 |
| 3,995,551 | A | | 12/1976 | Mitter | 101/118 |
| 4,489,493 | A | * | 12/1984 | Tsumura | 30/387 |
| 4,628,814 | A | | 12/1986 | Klemm | 101/123 |
| 4,751,528 | A | | 6/1988 | Spehrley, Jr. et al. | |
| 4,769,652 | A | | 9/1988 | Cleary et al. | 346/136 |
| 4,847,635 | A | | 7/1989 | Jackson et al. | 346/136 |
| 4,943,045 | A | | 7/1990 | Van Horne et al. | 271/277 |
| 4,950,099 | A | * | 8/1990 | Roellin | 403/348 |
| 4,957,402 | A | * | 9/1990 | Klein et al. | 411/84 |
| 4,982,207 | A | | 1/1991 | Tunmore et al. | |
| 5,067,705 | A | | 11/1991 | Van Horne et al. | |
| 5,079,980 | A | | 1/1992 | Oakes et al. | 83/19 |
| 5,118,208 | A | | 6/1992 | Kitahara et al. | |
| 5,124,728 | A | | 6/1992 | Denda | |
| 5,136,316 | A | | 8/1992 | Punater et al. | 346/153.1 |
| 5,195,836 | A | | 3/1993 | Longust et al. | |
| 5,263,414 | A | | 11/1993 | Lehrrieder et al. | 101/228 |
| 5,302,037 | A | | 4/1994 | Schoendienst et al. | 400/586 |
| 5,362,157 | A | * | 11/1994 | Ichida | 384/45 |
| 5,363,129 | A | | 11/1994 | Kline et al. | |
| 5,479,199 | A | | 12/1995 | Moore et al. | |
| 5,510,822 | A | | 4/1996 | Vincent et al. | |
| 5,517,912 | A | | 5/1996 | Winter | 101/114 |
| 5,592,202 | A | | 1/1997 | Erickson | 347/37 |
| 5,664,495 | A | | 9/1997 | Winter | 101/114 |

(List continued on next page.)

FOREIGN PATENT DOCUMENTS

| | | | |
|---|---|---|---|
| EP | 1 044 817 | A2 | 10/2000 |
| JP | 405084991 | A | 4/1993 |
| JP | 405131620 | A | 5/1993 |
| JP | 408142321 | A | 6/1996 |
| JP | 411207944 | A | 8/1999 |
| JP | 02000351205 | A | 12/2000 |

*Primary Examiner*—Andrew H. Hirshfeld
*Assistant Examiner*—Dave A. Ghatt
(74) *Attorney, Agent, or Firm*—Hamilton, Brook, Smith & Reynolds, P.C.

(57) ABSTRACT

A coupling assembly for a printing system that includes a threaded bolt that engages a threaded bore of a first dovetail nut. The assembly also includes a second dovetail nut with a bore through which a shaft of the bolt passes. Each dovetail nut has two tapered portions located on opposite sides of the bore of the respective nut. When the bolt/dovetail nut combination is assembled, the two dovetail nuts are located a distance apart so that the tapered portions of the two nuts define a pair of slots. To connect sections of the web guide together, each slot engages a flared connector of a respective section.

13 Claims, 10 Drawing Sheets

U.S. PATENT DOCUMENTS 5,742,315 A 4/1998 Szlucha et al.
5,751,303 A 5/1998 Erickson et al.
5,751,308 A 5/1998 Grandy et al. ..... 347/33
5,802,680 A * 9/1998 Postelwait ..... 24/135 R
5,883,654 A 3/1999 Katsuyama ..... 347/104
5,901,646 A 5/1999 Walker et al. ..... 101/123
5,904,429 A 5/1999 Goodwin et al.
5,954,467 A * 9/1999 Paisley et al. ..... 411/222
5,984,464 A 11/1999 Steinfield et al. ..... 347/87
6,196,672 B1 3/2001 Ito et al.
6,238,114 B1 5/2001 Bennett, III et al. ..... 400/625
6,261,008 B1 7/2001 Omura
6,263,657 B1 7/2001 Fietz ..... 57/406
6,276,778 B1 8/2001 Katayama
6,290,332 B1 9/2001 Crystal et al.
6,290,426 B1 * 9/2001 van Gijsel et al. ..... 403/374.3
6,315,404 B1 11/2001 Wotton et al.
6,328,439 B1 12/2001 Rhodes
2002/0071016 A1 6/2002 Wotton et al.

* cited by examiner

PRINTING SYSTEM WEB GUIDE COUPLING ASSEMBLY

RELATED APPLICATION

This application is a continuation-in-part of U.S. patent application Ser. No. 10/040,965, filed Jan. 7, 2002, which claims the benefit of U.S. Provisional Application No. 60/260,359, filed on Jan. 8, 2001, the entire teachings of which are incorporated herein by reference.

BACKGROUND

Certain types of printing systems are adapted for printing images on large-scale substrates, such as for museum displays, billboards, sails, bus boards, banners, and the like. The substrate can be a web or mesh-like material. In some of these systems, the web is fed along its length into the printing system. A carriage which holds a set of print heads scans across the width of the web while the print heads deposit ink as the web moves.

In many systems, a web guide directs the web through the printing system. The web guides generally include multiple sections coupled together. Some of these sections can be heated to condition the web prior to printing and to dry off the ink solvents after the image is printed. Furthermore, the systems are usually provided with a mechanism which keeps the web under tension to prevent it from wrinkling or bunching up.

SUMMARY

During the printing process, it is desirable to have the web move across a smooth outer surface of the web guide. Typically, the sections of the web guide when coupled together form joints with raised and/or indented regions. These joints can cause the web to bunch up or wrinkle. The present invention implements an assembly for coupling the various sections of a web guide of a printing system to provide a smooth guide surface.

In one embodiment, the assembly includes a threaded bolt that engages a threaded bore of a first dovetail nut. The assembly also includes a second dovetail nut with a bore through which a shaft of the bolt passes. Each dovetail nut has two tapered portions located on opposite sides of the bore of the respective nut. When the bolt/dovetail nut combination is assembled, the two dovetail nuts are located a distance apart so that the tapered portions of the two nuts define a pair of slots. To connect sections of the web guide together, each slot engages a flared connector of a respective section.

Some embodiments can include one or more of the following features. The slots can have the same shape as the flared connectors. The sections can be provided with T-slots which engage with T-connectors of the sections. In addition, at least one section can have a V-shaped edge which engages with a V-shaped groove of another section to form a joint.

The T-connectors, the threaded bolt, the first dovetail nut, and the second dovetail nut can be made of steel. The sections of the web guide as well as the T-shaped slots can be made of aluminum.

Related embodiments include a method of connecting together two or more sections of a web guide of a printing system. An edge of a first section is engaged with an edge of a second section to form a joint. The two sections are joined together with a coupling assembly, and the sections are secured to a base of the web guide with one or more connectors.

Some embodiments may have one or more of the following advantages. The coupling assembly provides an easy mechanism to join together various sections of the web guide. The assembly facilitates precisely aligning the edges of adjacent sections to minimize the existence of raised or indented surfaces. Accordingly, the web is able to move across a uniform and smooth surface of the web guide surface, which prevents the substrate from bunching up or wrinkling. The coupling assembly eliminates the need for de-wrinkling rolls or other devices which are used to de-wrinkle the web. The assembly also eliminates the need for guide rolls. The coupling assembly facilitates constructing the web guide as a monolithic effectively seamless structure for drying, guiding, and de-wrinkling the web. Since some of the components of the guide have the same shape, the number of shapes of the components is minimized.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
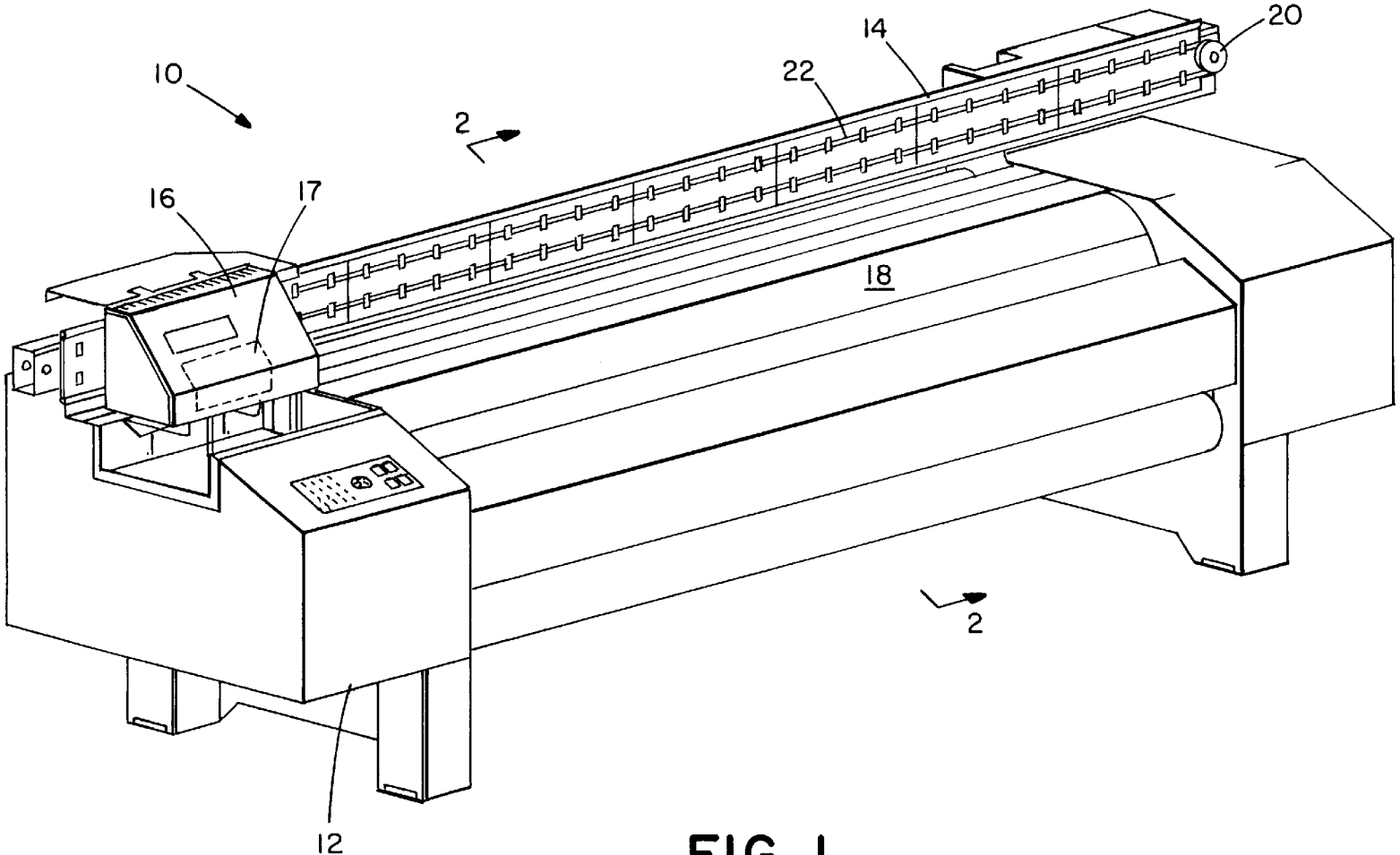
FIG. 1 is a perspective view of a printing system in accordance with an embodiment of the present invention.

Turning now to the drawings, there is shown in FIG. 1 a printing system 10, for example, a digital ink jet printing system, for printing images on large scale substrates such as webs, commonly referred to as scrims or meshes. These webs have holes with diameters that range from about 0.01 inch to about 0.25 inch. The webs are made, for example, from a plastic, such as polyvinyl or any other suitable material.

The printing system 10 includes a base 12, and a rail system 14 attached to the base 12. A carriage 16 which holds set of inkjet print heads 17 is mounted to the rail system 14, and a web guide 18 guides a substrate or web 28 (FIG. 2) through the printing system 10. A pair of pulleys (of which only one pulley 20 is shown) are positioned on either end of the rail system 14. One of the pulleys, for example, the pulley 20 is connected to a carriage motor, and the carriage 16 is attached to a belt 22 which wraps around both pulleys. Accordingly, as the carriage motor rotates the pulley 20, the carriage 16 traverses back and forth along the rail system 14 while the print heads 17 deposit ink onto the web as it moves through the printing system 10 to create a desired image on the web.

Figure 2:
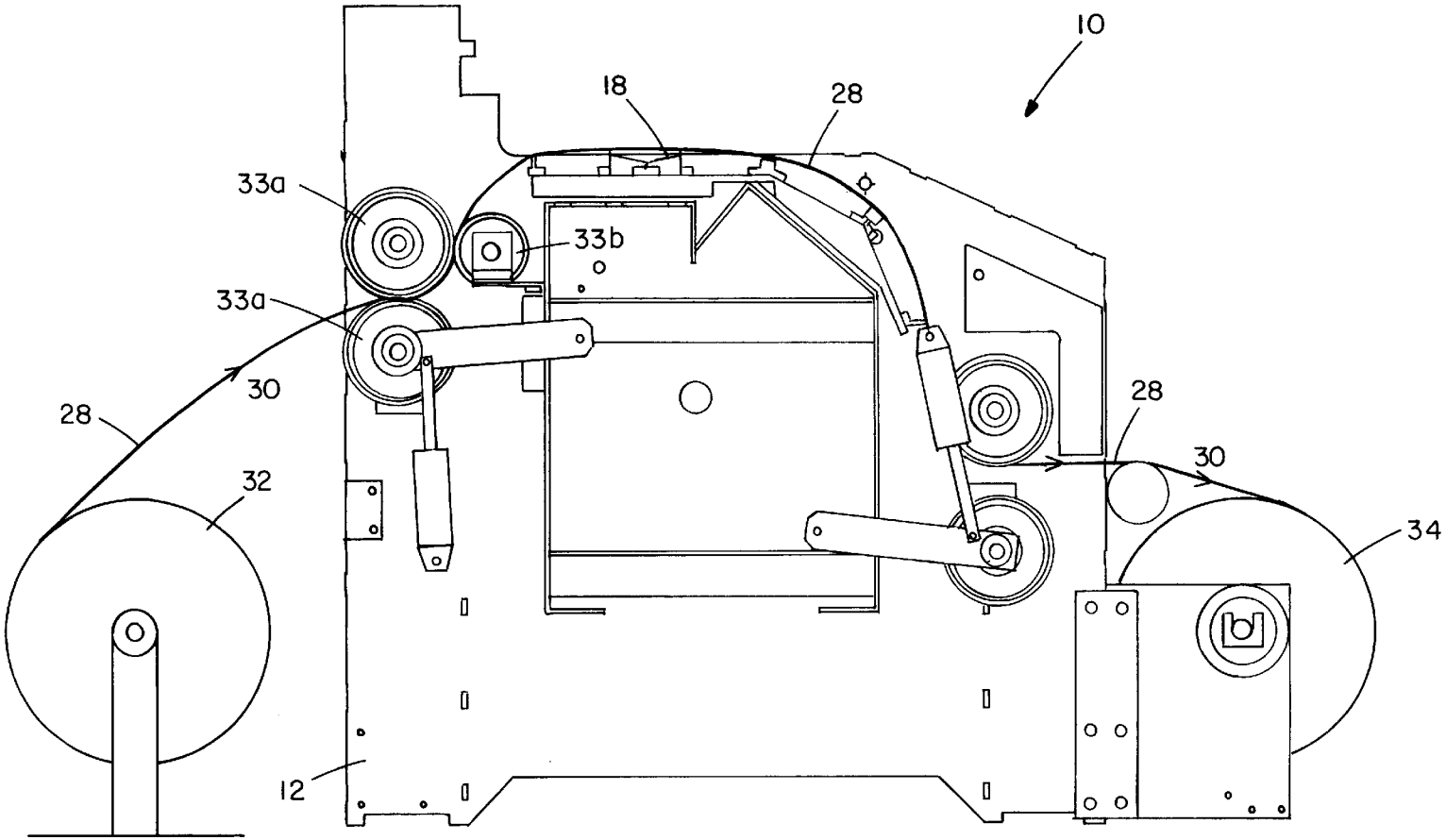
FIG. 2 is a cross-sectional side view of the printing system of FIG. 1 viewed along line 2—2 of FIG. 1.

Referring to FIG. 2, there is illustrated the path of the web 28 (indicated by arrows 30) as it is fed through the printing system 10. From a supply drum 32, the web 28 is guided through a pair of rollers 33*a* and over an additional roller 33*b* and then across the web guide 18. The web 28 is then is taken up by a take-up drum 34 attached to the printing system 10. The supply drum 32 actively feeds the web and includes a feedback mechanism to ensure that the web 28 is under tension. Alternatively, the web 28 can be supplied from a passive bar such that the take-up drum pulls 34 the web through the system.

Figure 3A:
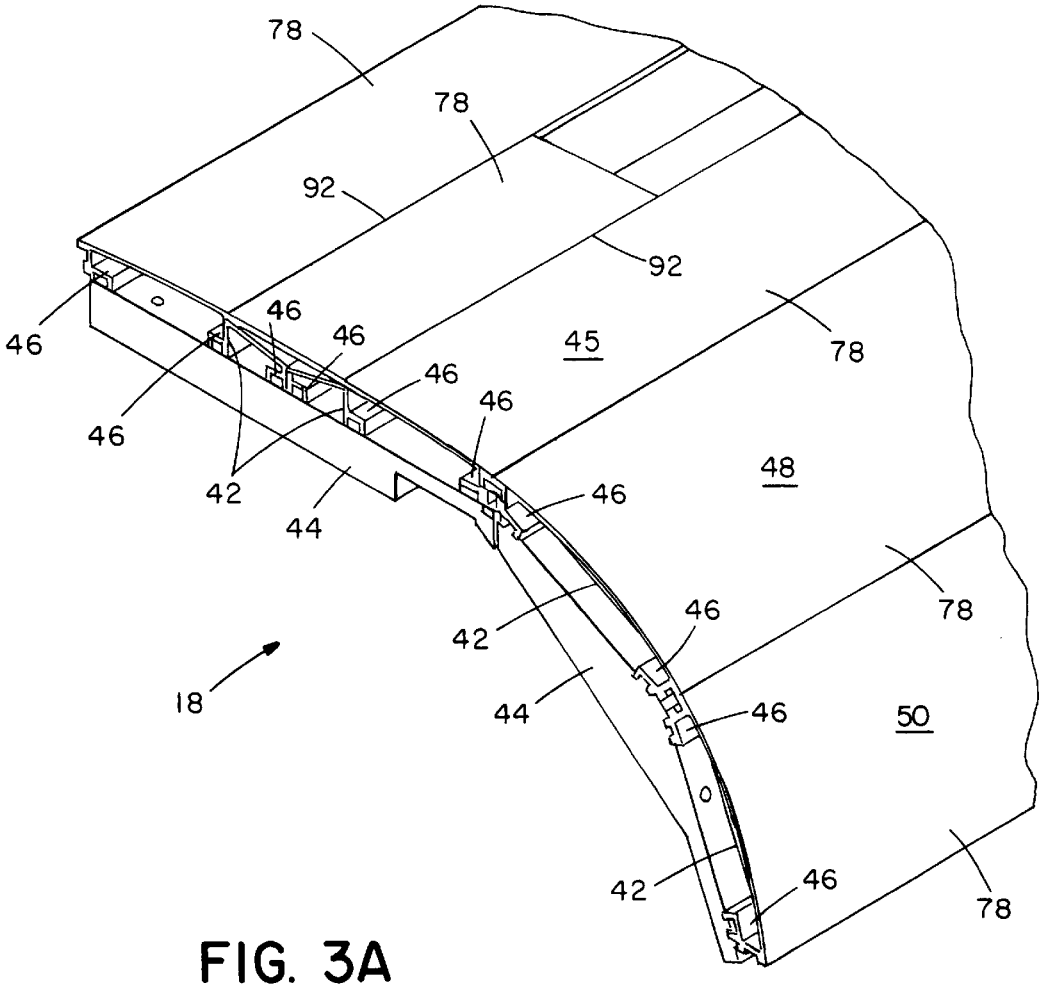
FIG. 3A is an perspective view of a web guide of the printing system of FIG. 1.
Figure 3B:
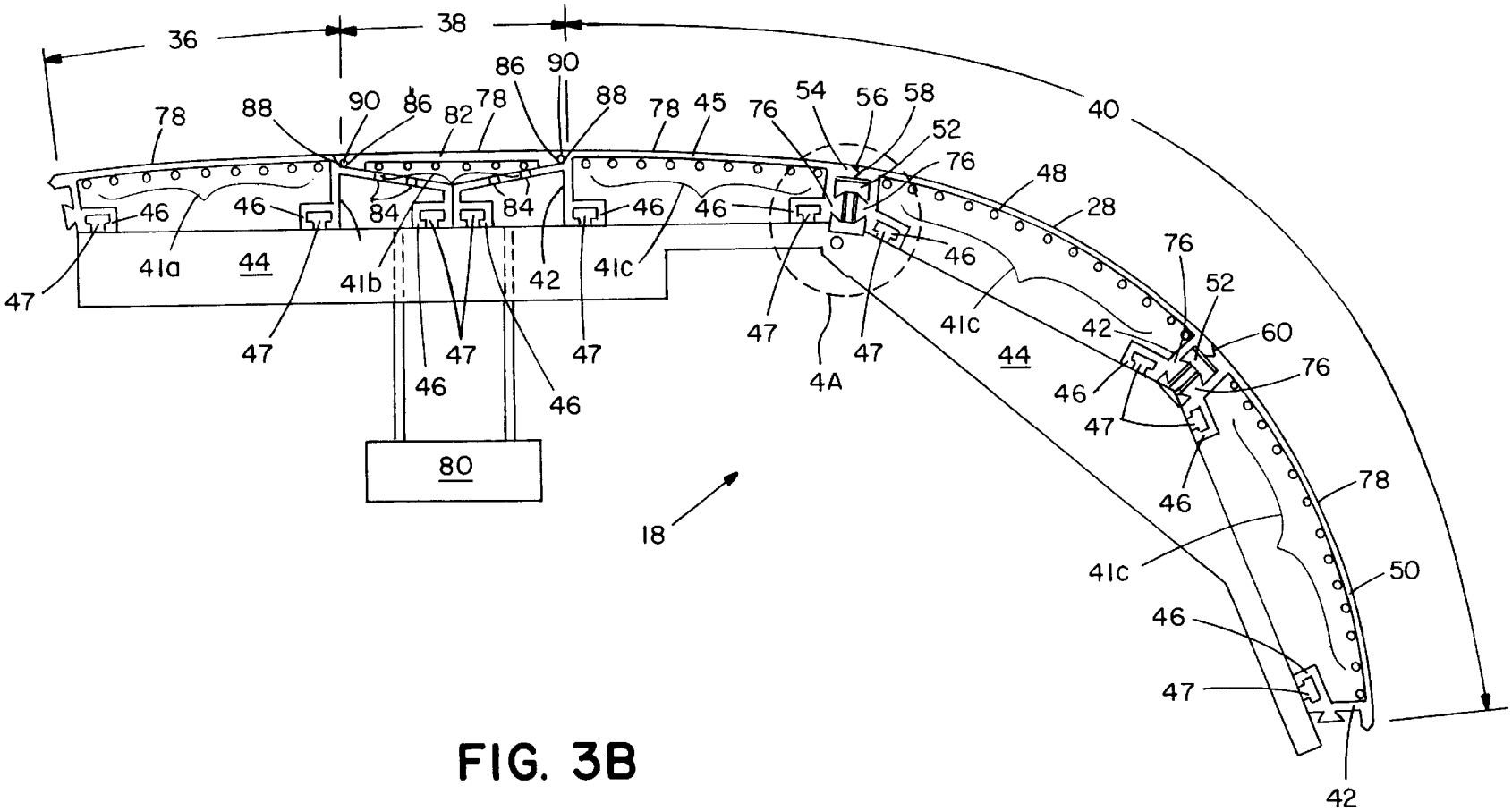
FIG. 3B is a side view of the web guide of FIG. 3A with a vacuum system.

Referring now to FIGS. 3A and 3B, the web guide 18 includes a preprinting section 36, a printing section 38, and a postprinting section 40. Each of these sections 36, 38, and 40 are provided with a multiplicity of heating elements 41*a*, 41*b*, and 41*c*, respectively, for example, resistive heating elements such as silicon strips positioned along the lengths of the sections. The sections can be heated from room temperature to about 300° F. The total heating capacity is about 5000 W. The heating capacity is adjustable, for example, to accommodate for different widths of the printing system 10, and hence the web guide 18. The total available power can be increased or decreased by changing the strips heaters 41*a*, 41*b*, and/or 41*c*. Additionally or alternatively, the heating capacity can be adjusted through temperature sensors and controllers.

The web 28 is heated in the preprinting section 36 and the printing section 38 conditions the web to control the spread of ink. The web is then heated in the postprinting section 40 to dry off solvents from the ink after the image is printed on the web 28. Note that heating the web in the printing section 38 can also help dry off the solvents in the ink.

As can readily been seen in FIGS. 3A and 3B, the postprinting section 40 is curved. By pulling the web 28 over this curved surface, a tension is maintained in the web 28. Further, this curvature increases the normal force on the web against the surface of the postprinting section 40 to ensure proper thermal contact between the web and this surface.

The sections 36, 38 and 40 are supported by a guide support structure 42 attached to a guide base 44. In particular, the guide support structure 42 is provided with T-slots 46 which are coupled with T-connectors 47 that are securely fastened to the guide base 44. Furthermore, the guide support structure 42 includes three subsections 45, 48, and 50 which support the postheating section 40. These three sections 45, 48, and 50 are clamped together by a set of bolt/dovetail nut assemblies 52. To ensure that these subsections 45, 48, and 50 are properly aligned, the subsection 45 is provided with a V-shaped edge 54 that fits into a V-shaped slot 56 of the subsection 48 to form a joint 58. An identical joint 60 is formed between the subsection 48 and the subsection 50. The T-slot 46/T-connector 47, the bolt/dovetail nut assemblies 52, and the joints 58 and 60 are used to create a uniform surface across the sections 36, 38, and 40 over which the web 28 moves.

Figure 4A:
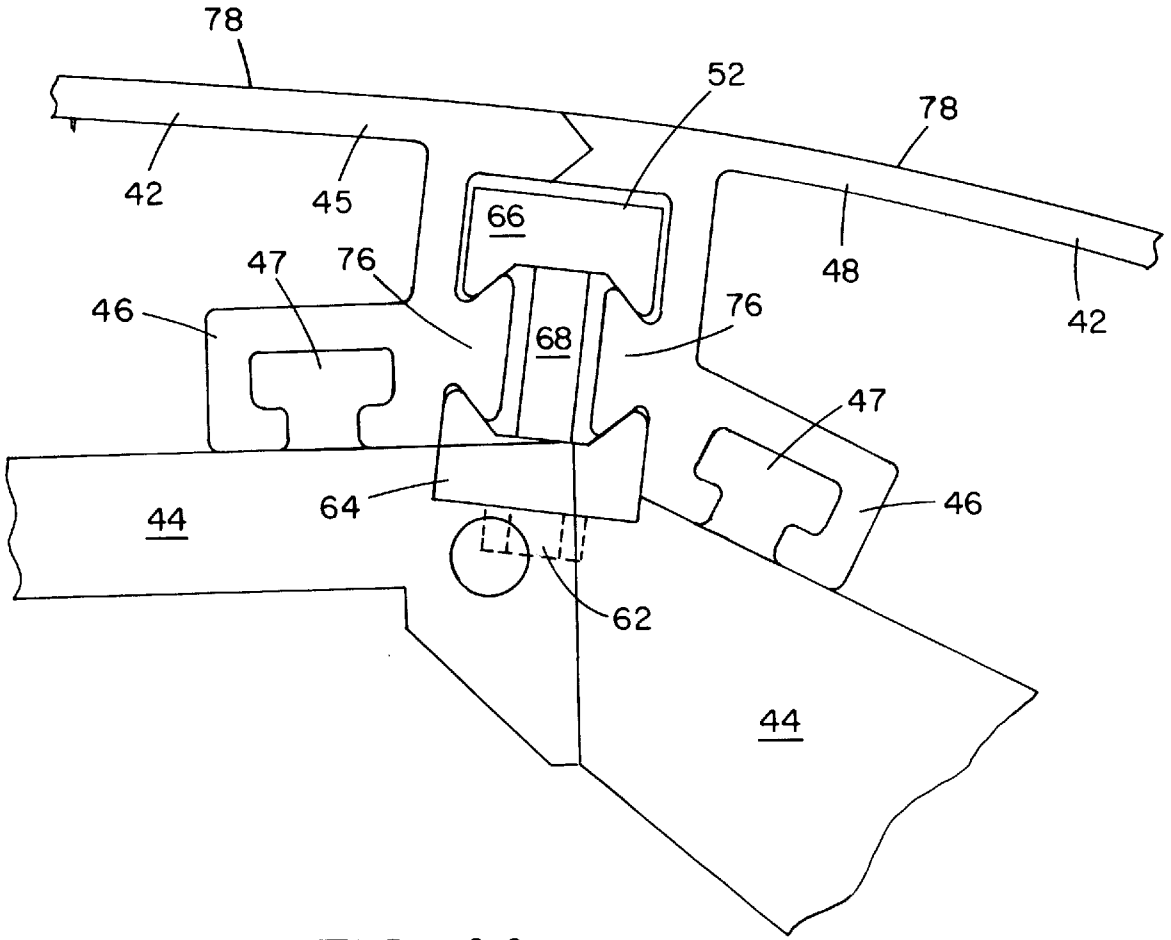
FIG. 4A is a close-up view of region 4A of FIG. 3A of two sections of the web connected by a connector assembly.
Figure 4B:
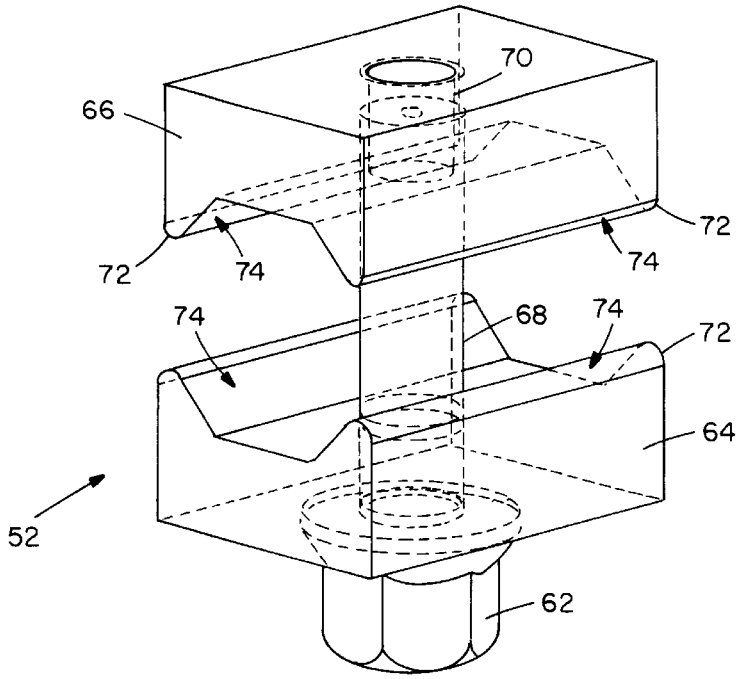
FIG. 4B is a perspective view of the connector assembly of FIG. 4A.

An individual bolt/dovetail nut assembly 52 is shown in greater detail in FIGS. 4A and 4B. Each bolt/dovetail nut assembly 52 includes a bolt 62, an annular dovetail nut 64, and a threaded dovetail nut 66. As a unit, the bolt/dovetail nut assembly 52 is assembled such that a shaft 68 of the bolt 62 passes through the annular dovetail nut 64 and a threaded end 70 of the bolt 62 engages with the threaded dovetail nut 66. Each of the annular dovetail nut 64 and the threaded dovetail nut 66 includes a pair of tapered edges 72. These tapered edges 72 define a pair of slots 74 which engage with flared connectors 76 of the subsections 45 and 48 (FIG. 4A), as well as the subsection 50 (FIG. 3B).

The guide support structure 42 and the web guide base 44 are, in certain embodiments, made from aluminum, and the T-connectors 47 are made from steel. The bolt 62, the annular dovetail nut 64, and the threaded dovetail nut 66 of the bolt/dovetail nut assemblies 52 are also made from steel in some embodiments. To further minimize friction between the web 28 and the web guide 18, the outer surface of the web guide 18 is coated with a low friction material 78, such as, for example, Teflon or any other suitable material.

Figure 5:
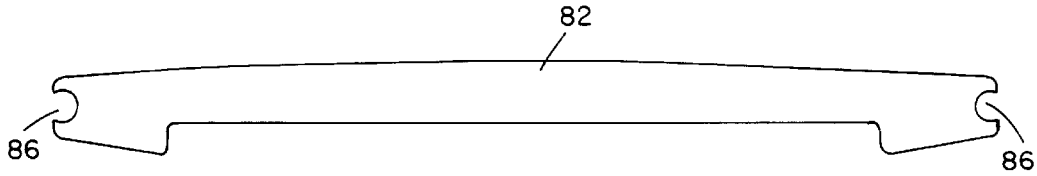
FIG. 5 is close-up side view of a removable platen of the web guide of FIGS. 3A and 3B.
Figure 6:
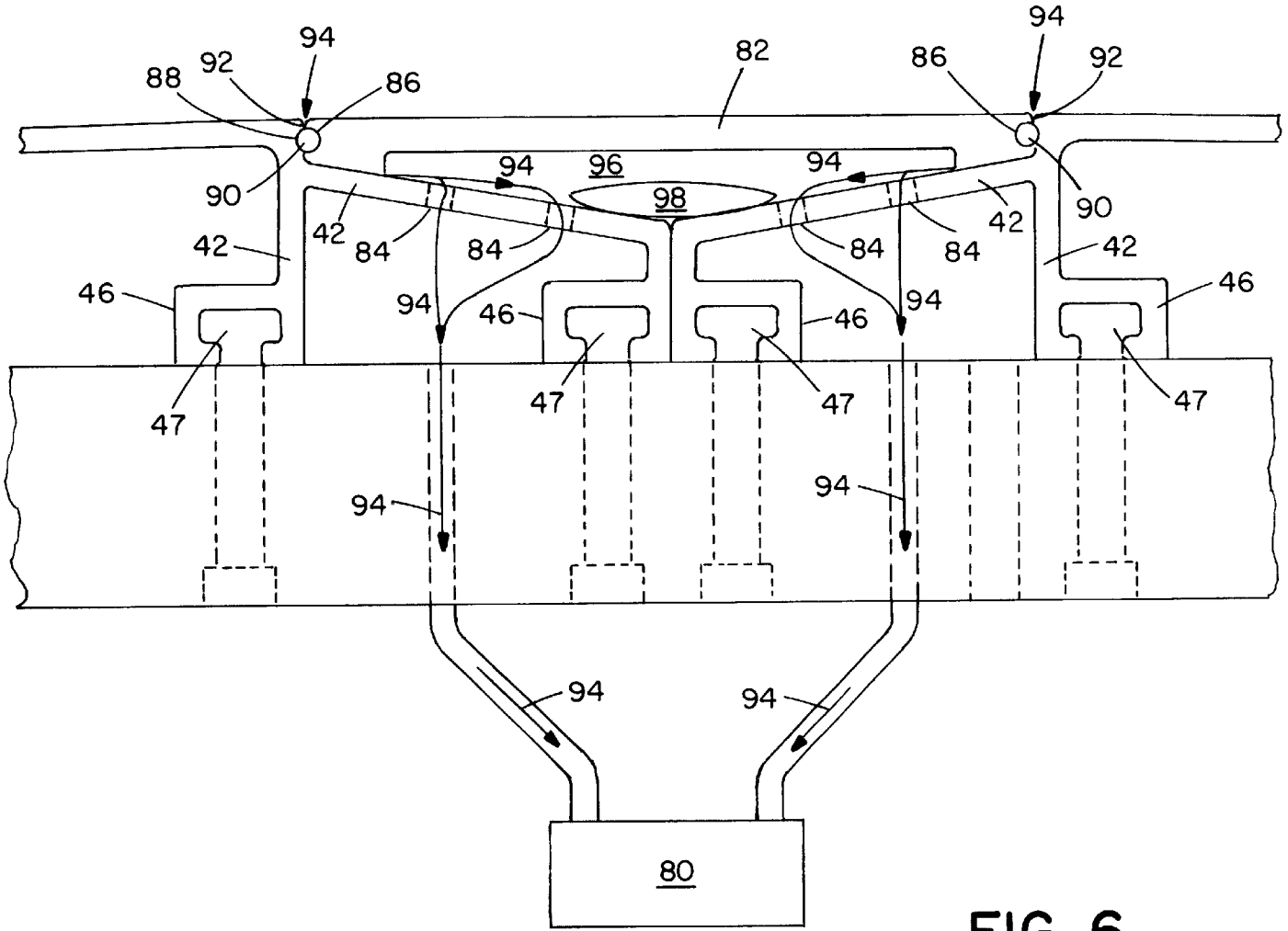
FIG. 6 is a close-up view of the printing section of the web guide of FIGS. 3A and 3B.

Referring back to FIG. 3B, the printing section 38 is connected to a vacuum generator or source 80 and includes a removable flat panel or platen 82 (FIG. 5). The platen 82 provides support for the web 28 as the print heads 17 deposit ink onto the web. Members of the guide support structure 42 located underneath the platen 82 include a set of holes 84 (FIG. 6) which provide a flow path through which the vacuum generator 80 draws a vacuum to the platen 82. The platen 82 is provided with a semicircular groove 86 on either side of the platen 82. There is a corresponding pair of grooves 88 on the preprinting section 36 and the postprinting section 40 of the guide support structure 42 which match with the grooves 86. When the platen 82 is in place, a pair of circular rods 90 made from, for example, an elastomer fit into the orifices defined by the grooves 86 and the respective grooves 88 to secure the platen 82 to the guide support structure 42. Further, the longitudinal sides of the platen 82 define with a corresponding edge of the support structure 42 a pair of narrow slots 92. When a vacuum is desired, the rods 90 are removed and the vacuum generator 80 draws a vacuum through the holes 84 and along the slots 92, as indicated by the arrows 94 in FIG. 6. The vacuum along the slots 92 generates a suction on the web 28 to minimize or prevent wrinkling of the web 28 as it moves across the printing section 38. Also, the suction draws the web 28 away from the print heads 17. This prevents contact between the web 28 and the print heads 17 and minimizes damage to the heads.

In use, the web 28 first moves through the preprinting section 36 of the web guide 18. Here, the heating elements 41*a* raise the temperature of the outer surface of the preprinting section 36 and consequently the web 28 to condition the web 28 prior to printing. As the web 28 intermittently moves through the printing section 38, the carriage 16 moves back and forth along the rail system 14 while the inkjet print heads 17 deposit ink onto the web. The web 28 then moves out of the printing section 38 and over the outer surface of the postprinting section 40. The heating elements 41*b* and 41*c* of the printing section 38 and the postprinting section 40, respectively, cause the temperature of the ink to increase thereby drying off the solvents in the ink. Finally, the take-up drum 34 rolls up the web 28 as the drum rotates. The rolled-up web 28 is easier to move for further processing or shipment to the customer.

In certain applications, the vacuum generator 80 is turned off and the platen 82 is removed so that the web 28 bridges a gap 96 as the web moves through the printing section 38. This allows excess ink to fall into a cavity or trough 97 through the web to prevent excess ink buildup and smearing underneath the web 28. An absorber 98 located at the bottom of the trough 97 collects the excess ink in such applications. Additionally or alternatively, a drain plug can be located at the bottom of the trough to drain the excess ink. Note that when the vacuum generator 80 is in use and the platen 82 is in place, portions of the trough 97 can be closed off with a block or any other suitable device to draw the vacuum only across the width of the web.

While this invention has been particularly shown and described with references to preferred embodiments thereof, it will be understood by those skilled in the art that various changes in form and details may be made therein without departing from the scope of the invention encompassed by the appended claims.

Figure 7:
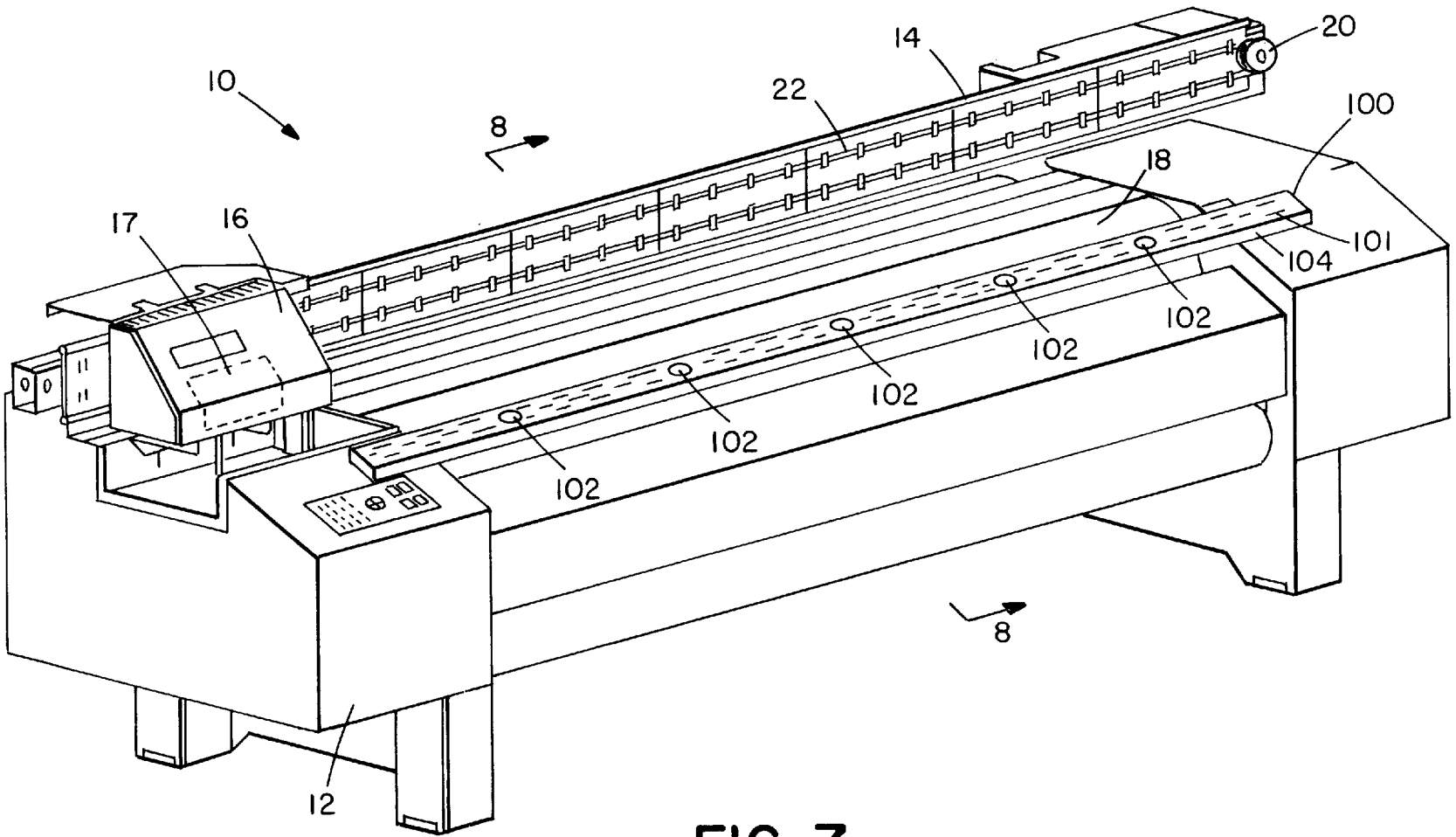
FIG. 7 is a perspective view of an alternative embodiment of the printing system in accordance with the present invention.
Figure 8:
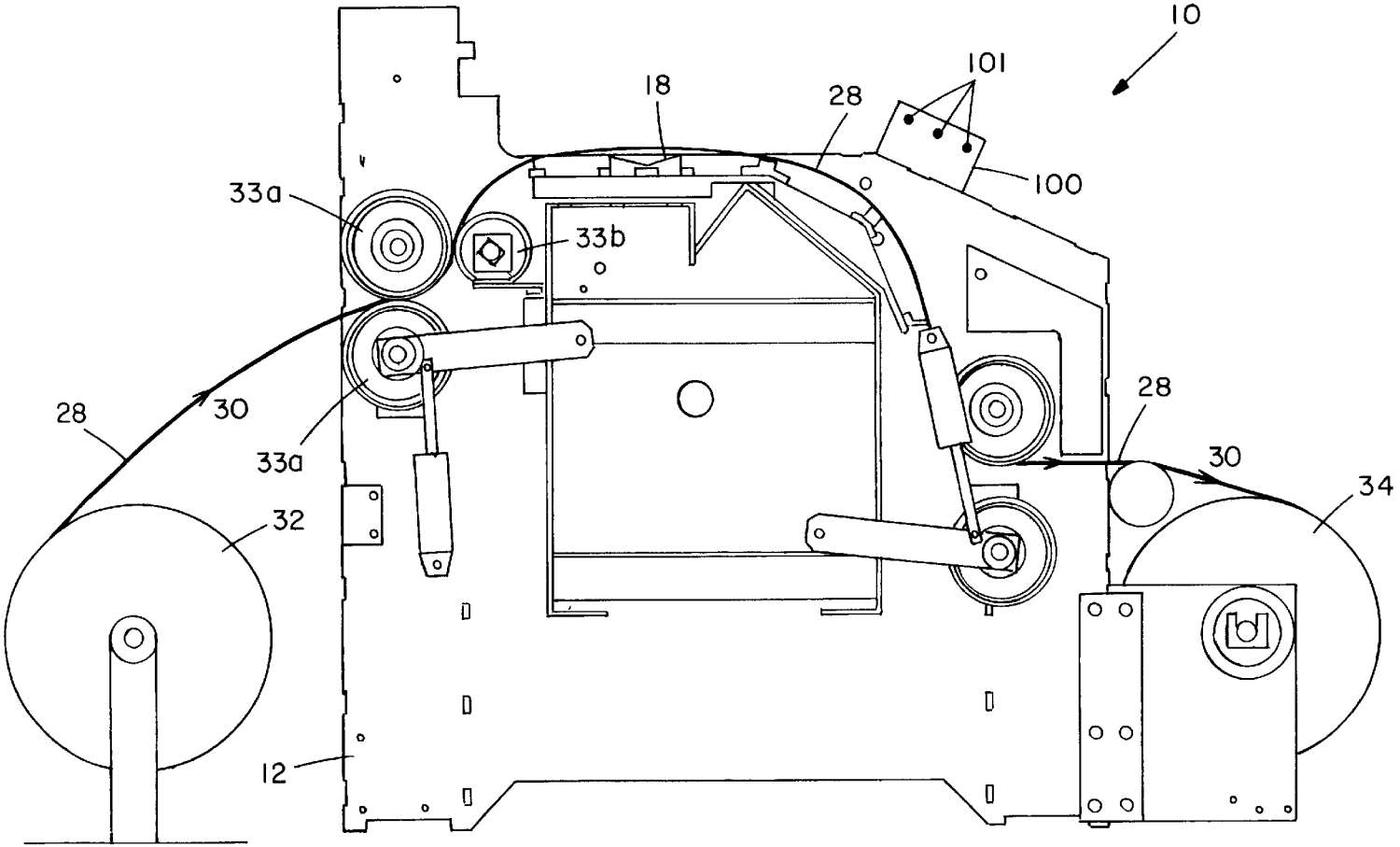
FIG. 8 is a cross-sectional side view of the printing of FIG. 7 viewed along the line 8—8 of FIG. 7.

For example, there is shown in FIGS. 7 and 8 a printing system 10 that includes a heater 100 mounted to the base 12. The heater 100 includes one or more infrared heating elements 101 enclosed within an housing 104 along the length of the heater 100. The heating elements 101, in one embodiment, emit infrared energy towards the ink deposited on the substrate or web as it moves underneath the heater 100. The heater 100 has a power output of about 5000 W, for example, for three-meter wide web guide. The available power can be adjusted so that the heater 100 can be used for web guides of different widths. To adjust the power output, the heating elements 101 can be changed to those with the appropriate power output, and/or the power can be adjusted through the use of temperature sensors and controllers.

Accordingly, the heater 100 alone or in combination with the heating elements 41*c* of the postprinting section 40 generates a sufficient amount of energy to dry off solvents from the deposited ink. In certain embodiments, the heater 100 also includes a series of fans 102 which blow air over the heating elements 101 such that heat is transmitted to the substrate or both by both radiative and convective heat transfer mechanisms from the heater 100. The fans 102 also help distribute the heat evenly to prevent hot spots from occurring on the substrate while driving off evaporating solvents.

Figure 9A:
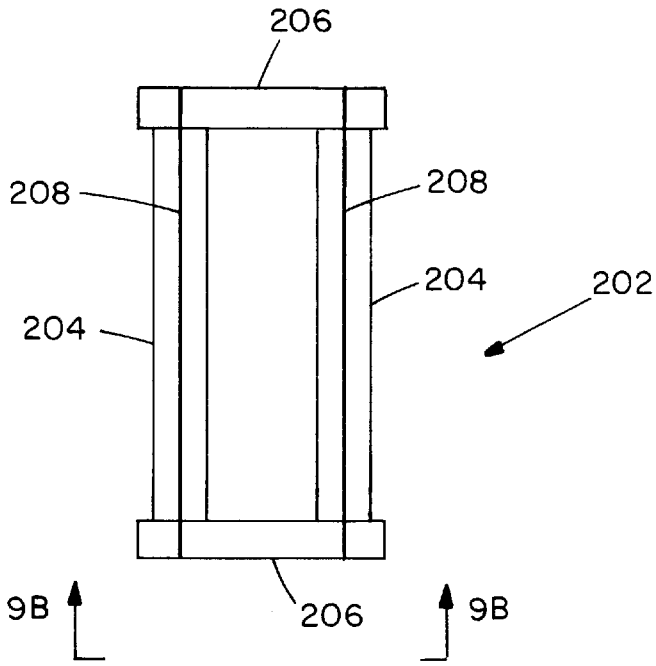
FIG. 9A is a top view of a cradle mechanism to provide a supply of web to the printing system.
Figure 9B:
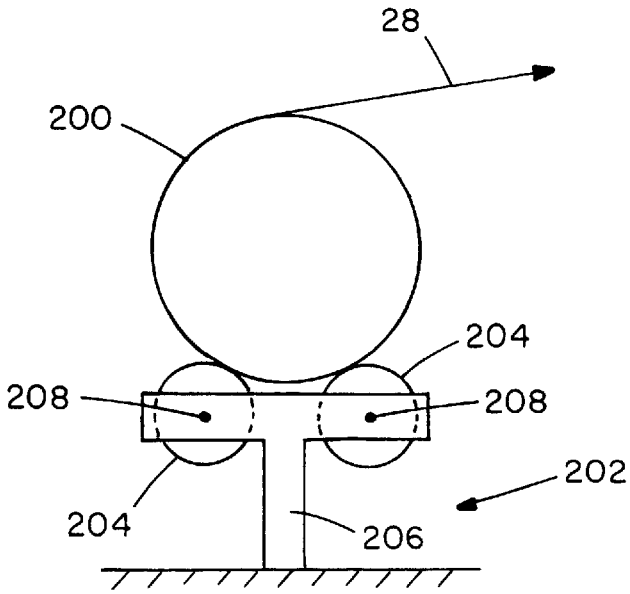
FIG. 9B is a side view of the cradle mechanism of FIG. 9A along the line 9B—9B.

In some embodiments, the web 28 is supplied from a roll of web 200 supported by a cradle mechanism 202, as shown in FIGS. 9A and 9B. The cradle mechanism includes a pair of spaced apart rollers 204 supported by a pair of stands 206. In some arrangements, each roller 204 rotates about a stationary rod 208 secured at each end to a respective stand 206. Alternatively, rollers 204 can be fixed to the rods 208 such that the ends of the rods 208 rotate within bearings secured to the stands 206.

What is claimed is:

1. A printing system having a coupling assembly for connecting together one or more sections of a web guide of the printing system, comprising:

a threaded bolt, a first nut having tapered portions and an inner threaded bore with which the threaded bolt engages, the threaded inner bore being positioned between the tapered portions; and a second nut, the second nut having tapered portions and a bore through which a shaft of the bolt passes, the bore being positioned between the tapered portions of the second nut, the first nut and the second nut being positioned a distance apart so that the tapered portions of the first nut and the tapered portions of the second nut define a pair of slots with the bolt being positioned between the slots, each slot engaging a flared connector of a respective section of the web guide.

2. The system of claim 1, wherein the slots have substantially the same shape as the flared connectors and the nuts are dovetailed.

3. The system of claim 1, further comprising a multiplicity of T-connectors secured to a base of the web guide which engage with respective T-slots of the sections of the web guide.

4. The system of claim 3, wherein the T-connectors are made of steel.

5. The system of claim 1, wherein at least one section of the web guide has a V-shaped edge which engages with a V-shaped groove of another section to form a joint.

6. The system of claim 5, wherein the bolt, the first dovetail nut, and the second dovetail nut are positioned adjacent to the joint such that an axis of the bolt is substantially perpendicular to an axis along the joint.

7. The system of claim 1, wherein the bolt, the first dovetail nut, and the second dovetail nut are made of steel.

8. The system of claim 1, wherein the bolt, the first dovetail nut, and the second dovetail nut connect a pair of sections of the web guide.

9. The system of claim 1, wherein the sections are made from aluminum.

10. A method of connecting together two or more sections of a web guide of a printing system, comprising:

engaging an edge of a first section with an edge of a second section to form a joint;

joining together the two sections with a coupling assembly; and securing the sections to a base of the web guide with one or more connectors wherein the coupling assembly includes a threaded bolt, a first nut having tapered portions and an inner threaded bore with which the threaded bolt engages, the threaded inner bore being positioned between the tapered portions; and a second nut, the second nut having tapered portions and a bore through which a shaft of the bolt passes, the bore of the second nut being positioned between the tapered portions of the second nut, the first nut and the second nut being positioned a distance apart so that the tapered portions of the first nut and the tapered portions of the second nut define a pair of slots with the bolt being positioned between the two slots, each slot engaging a flared connector of a respective section of the web guide.

11. The method of claim 10 wherein the slots have substantially the same shape as the flared connectors and the nuts are dovetailed.

12. The method of claim 10 wherein the connectors are T-connectors which engage with respective T-slots of the sections of the web guide.

13. The method of claim 10 wherein the edge of the first section is a V-shaped edge and the edge of the second section is a V-shaped groove.

* * * * *